US010952553B1

(12) United States Patent
Breon

(10) Patent No.: US 10,952,553 B1
(45) Date of Patent: Mar. 23, 2021

(54) BEDDING COVERS AND BEDDING COVER SYSTEMS

(71) Applicant: Alia Breon, Portland, OR (US)

(72) Inventor: Alia Breon, Portland, OR (US)

( * ) Notice: Subject to any disclaimer, the term of this patent is extended or adjusted under 35 U.S.C. 154(b) by 0 days.

(21) Appl. No.: 16/655,729

(22) Filed: Oct. 17, 2019

(51) Int. Cl.
*A47G 9/00* (2006.01)
*A47G 9/02* (2006.01)

(52) U.S. Cl.
CPC ..... *A47G 9/0215* (2013.01)

(58) Field of Classification Search
CPC ..... A47C 9/02; A47C 9/0215; A47C 9/07
See application file for complete search history.

(56) References Cited

U.S. PATENT DOCUMENTS

2003/0233706 A1* 12/2003 Birch ..... A47G 9/0207 5/502

* cited by examiner

*Primary Examiner* — Fredrick C Conley
(74) *Attorney, Agent, or Firm* — Mohr Intellectual Property Law Solutions, PC

(57) ABSTRACT

Bedding covers for selectively covering an insulated bedding item. The bedding covers include a cover member, a flap member, and a cover fastener. The cover member is complementarily configured with the length and the width of the insulated bedding item. The cover member has a cover top edge having a cover width at least as wide as the width of the insulated bedding item. The flap member is coupled to the cover member along the cover top edge. The cover fastener is configured to secure the cover member to the insulated bedding item and is disposed on either the cover member or the flap member. The cover member and the flap member collectively define a flap configured to receive a portion of the insulated bedding item. The cover fastener and the flap cooperate to secure the insulated bedding item within the flap.

19 Claims, 8 Drawing Sheets

BEDDING COVERS AND BEDDING COVER SYSTEMS

BACKGROUND

The present disclosure relates generally to bedding covers and bedding cover systems. In particular, bedding covers for covering insulated bedding items and bedding cover systems including a bedding cover and an insulated bedding item are described.

Bedding items, including sheets, blankets, duvets, and duvet covers, are used by people almost every day. In addition to personal use of bedding items in one's home, the hospitality industry, including resorts, hotels, and individuals renting their private property on a short term basis, makes regular use of bedding items for guests. Individuals in their own homes and guests at rented rooms expect bedding items to be clean and comfortable.

Duvets, blankets, and comforters, collectively referred to here as insulated bedding items, are popular types of bedding items. However, insulated bedding items can be a challenge to clean given their size and bulk. The challenges present with cleaning insulated bedding items lead to them not being cleaned sufficiently often, which can create unhygienic conditions.

Conventional duvet covers are designed to be removed from insulated bedding items for cleaning. While duvet covers are easier to clean than the insulated bedding items they cover, inserting and removing insulated bedding items to and from duvet covers is awkward and difficult. The difficulties that exist with using conventional duvet covers results in the duvet covers not being washed sufficiently often.

Thus, there exists a need for bedding covers and bedding cover systems that improve upon and advance the design of known duvet covers and bedding systems. Examples of new and useful bedding covers and bedding cover systems relevant to the needs existing in the field are discussed below.

SUMMARY

The present disclosure is directed to bedding covers for selectively covering an insulated bedding item. The bedding covers include a cover member, a flap member, and a cover fastener. The cover member is complementarily configured with the length and the width of the insulated bedding item. The cover member has a cover top edge having a cover width at least as wide as the width of the insulated bedding item. The flap member is coupled to the cover member along the cover top edge. The cover fastener is configured to secure the cover member to the insulated bedding item and is disposed on either the cover member or the flap member. The cover member and the flap member collectively define a flap configured to receive a portion of the insulated bedding item. The cover fastener and the flap cooperate to secure the insulated bedding item within the flap.

DETAILED DESCRIPTION

Figure 1:
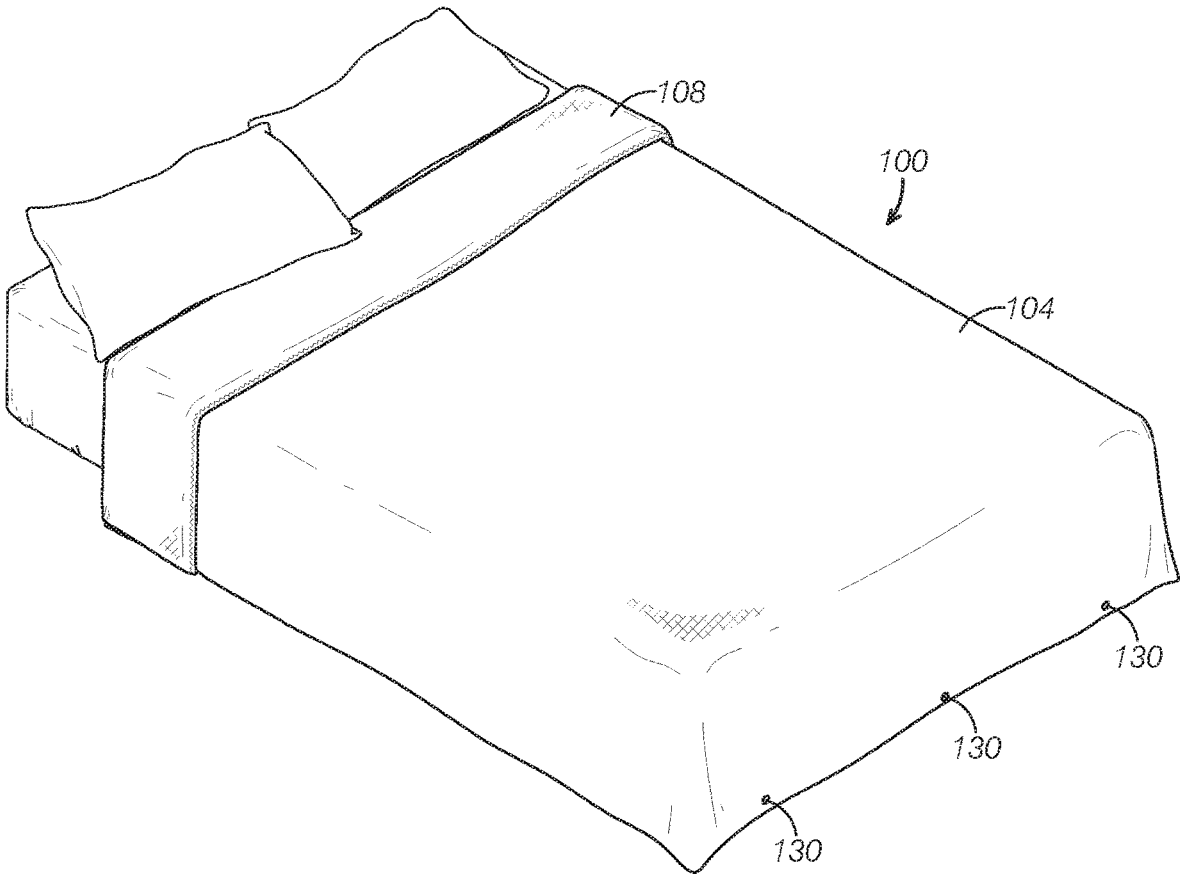
FIG. 1 is a perspective view of a bedding cover covering an insulated bedding item on a bed with a portion of the bedding cover near the head of the bed folded over on itself.

The disclosed bedding covers and bedding cover systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity each and every contemplated variation is not individually described in the following detailed description.

Throughout the following detailed description, examples of various bedding covers and bedding cover systems are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Contextual Details

The features of items used in conjunction with the bedding covers and bedding cover systems described herein will first be described to provide context and to aid the discussion of the bedding covers and bedding cover systems.

Insulated Bedding Item

The bedding covers described below are configured to cover an insulated bedding item. In the present document, an insulated bedding item may be any bedding item configured to overlie a mattress and that may benefit from being covered to facilitate cleaning. Common examples of insulated bedding items include duvets, blankets, and comforters. The insulated bedding item may be any currently known or later developed style of bedding item designed to overlie a mattress.

Figure 2:
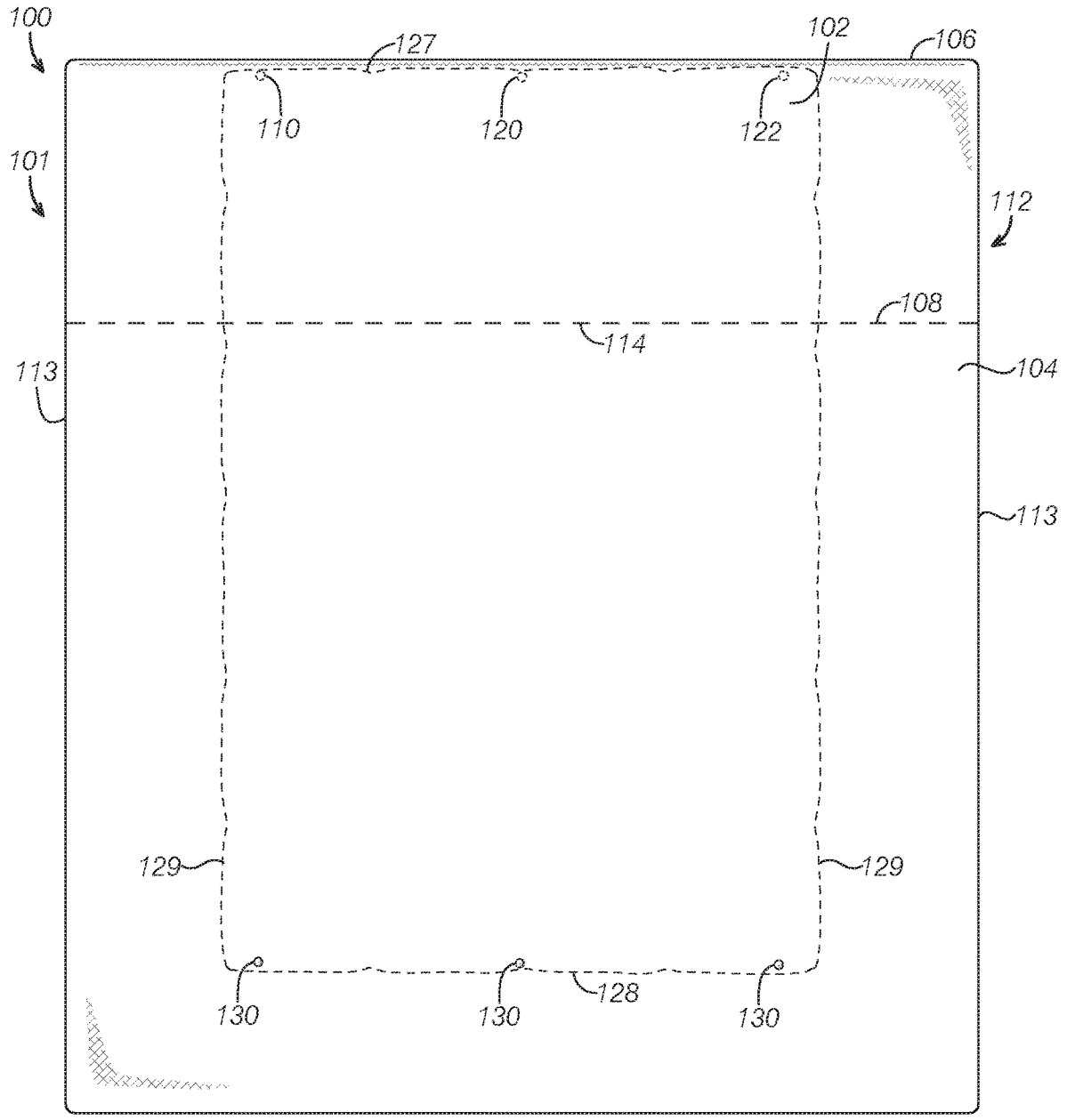
FIG. 2 is a top view of the bedding cover shown in FIG. 1 covering the insulated bedding item with the bedding cover lying flat, FIG. 2 depicting in dashed lines the insulated bedding item, a flap member underneath the insulated bedding item, three interference fit fasteners near the head of the bed coupling the bedding cover to the insulated bedding item, and three interference fit fasteners near the foot of the bed coupling the bedding cover to the insulated bedding item.
Figure 3:
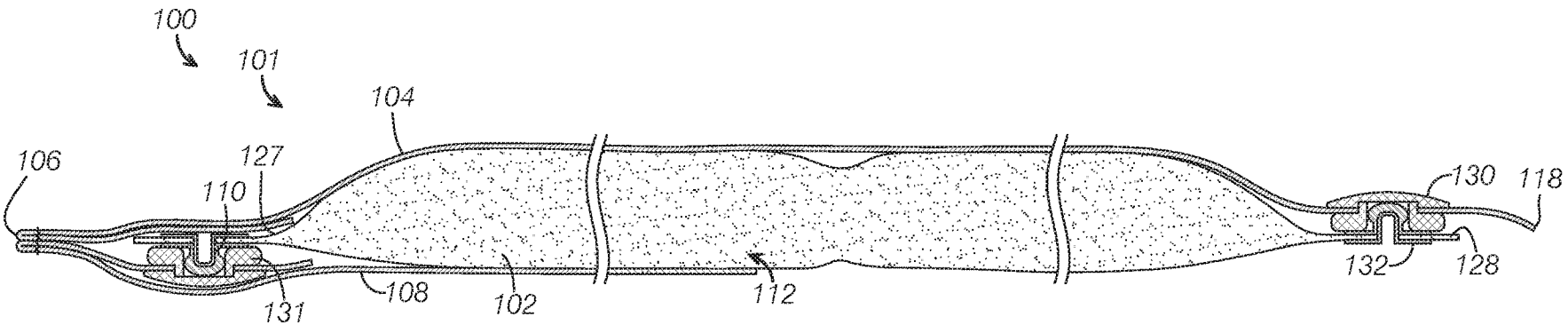
FIG. 3 is a side view of the bedding cover shown in FIG. 1 covering the insulated bedding item with the bedding cover lying flat, FIG. 2 depicting in dashed lines the insulated bedding item, a flap member underneath the insulated bedding item, an interference fit fastener near the head of the bed coupling the bedding cover to the insulated bedding item, and an interference fit fastener near the foot of the bed coupling the bedding cover to the insulated bedding item.
Figure 4:
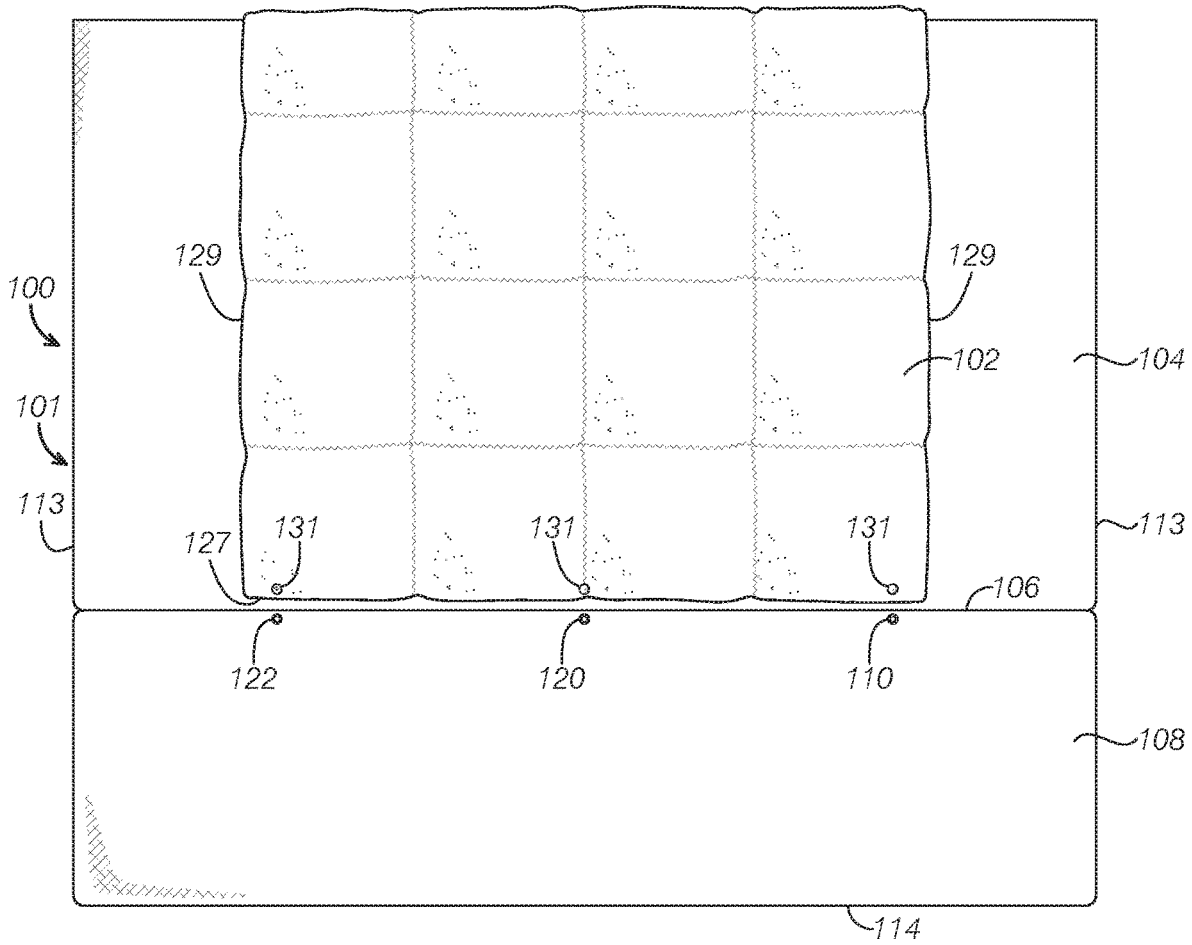
FIG. 4 is a top view of the bedding cover shown in FIG. 1 with the insulated bedding item and the bedding cover folded towards the foot of the bed and the flap member extending past the foot of the bed to facilitate securing the insulated bedding item to fasteners on a cover member and then folding the flap member over the insulated bedding member within a flap defined by the flap member and cover member.

In FIGS. 2-4, the reader can see one example of an insulated bedding item, insulated bedding item 102. Insulated bedding item 102 is a duvet, and in other examples, is a comforter or a blanket.

Insulated bedding item 102 extends from a bedding top edge 127 to a bedding bottom edge 128 and between bedding lateral edges 129. As shown in FIG. 3, bedding bottom edge 128 underlies a cover bottom edge 118 when cover member 104 overlies insulated bedding item 102. A length of insulated bedding item 102 is defined by the distance between bedding top edge 127 and bedding bottom edge 128. A width of insulated bedding item 102 is defined by the distance between bedding lateral edges 129.

In the example shown in FIGS. 1-5, insulated bedding item 102 includes optional bedding top edge fasteners 131 and bedding bottom edge fasteners 132. As shown in FIG. 3, bedding top edge fasteners 131 and bedding bottom edge fasteners 132 are snaps or interference fit fasteners. A wide variety of other fastener types are suitable, including buttons, magnets, ties, hook-and-loop fasteners, and the like.

The bedding fasteners are aligned with and complementarily configured with fasteners included in the bedding covers discussed below, including a first cover fastener 110, a second cover fastener 120, a third cover fastener 122, and cover bottom edge fastener 130. In particular, bedding top edge fasteners 131 are aligned with and complementarily configured with first cover fastener 110, a second cover fastener 120, a third cover fastener 122 and bedding bottom edge fasteners 132 are aligned with and complementarily configured with cover bottom edge fasteners 130.

The bedding covers described in this application do not require fasteners in the cover or in the insulated bedding item, but some examples include them to secure the insulated bedding item to the cover for convenience. In some examples, neither the insulated bedding item nor the bedding covers include fasteners. In certain examples, the bedding cover includes fasteners, such as ties configured to tie around corners of the insulated bedding item, and the insulated bedding item does not include fasteners.

In examples where fasteners are utilized, different numbers of bedding fasteners and cover fasteners are provided than shown in the present example. For example, the insulated bedding item and/or the bedding cover may include a single fastener, two fasteners, three fasteners, four fasteners, or five or more fasteners. In some examples, a long, continuous fastener, such as a hook-and-loop fastener, runs along a majority of the bedding top edge.

Bedding Cover

With reference to the figures, various bedding cover examples will now be described. The bedding covers discussed herein function to cover an insulated bedding item and to facilitate regular cleaning. In particular, the bedding covers described in this document are configured to be quickly and conveniently installed over insulated bedding items and to be quickly and easily removed from the insulated bedding item for cleaning. The ready and convenient manner in which the present bedding covers may be installed, removed, and cleaned effectively address the shortcomings of conventional duvet covers.

Bedding Cover Embodiment One

With reference to FIGS. 1-5, a first example of a bedding cover, bedding cover 100, will now be described. Bedding cover 100 includes a cover member 104, a flap member 108, a first cover fastener 110, a second cover fastener 120, a third cover fastener 122, and cover bottom edge fasteners 130. In some examples, the cover does not include one or more features included in cover 100. For example, some cover examples do not include any fasteners or include fewer fasteners than included in the present example, such as a single fastener.

A bedding cover system 101 includes bedding cover 100 and insulated bedding item 102. The bedding cover systems contemplated in this document include the specific bedding covers and insulated bedding items described as well as bedding covers and insulated bedding items with additional or alternative features.

Cover Member

As can be seen in FIG. 2, cover member 104 is complementarily configured with the length and the width of insulated bedding item 102. Cover member 104 has a cover top edge 106 and a cover bottom edge 118 opposite cover top edge 106. Cover member 104 has a cover width corresponding to cover top edge 106 that is wider than the width of insulated bedding item. The cover width in other examples may be wider or narrower than that shown in FIGS. 1-5 and will typically be at least as wide as the width of the insulated bedding item.

Cover member 104 and flap member 108 are comprised of a washable fabric material to facilitate washing bedding cover 100. The washable fabric material may be any currently known or later developed fabric suitable for bedding applications and washing, including materials comprised of cotton, wool, flannel, silk, satin, linen, synthetics, or combinations thereof. In the present example, cover member 104 and flap member 108 are comprised of the same material, but may be different materials in other examples. With brief reference to a third embodiment of a bedding cover, bedding cover 300 shown in FIG. 7, the reader can see that a cover member 304 and a flap member 308 are integrally connected from of a common fabric material rather than two material pieces fastened together like cover member 104 and flap member 108 shown in FIGS. 1-5.

Flap Member

In the example shown in FIGS. 1-5, flap member 108 is coupled to cover member 104 along cover top edge 106. Cover member 104 and flap member 108 collectively define a flap 112. As shown in FIG. 3, flap 112 is configured to receive a portion of insulated bedding item 102.

Figure 5:
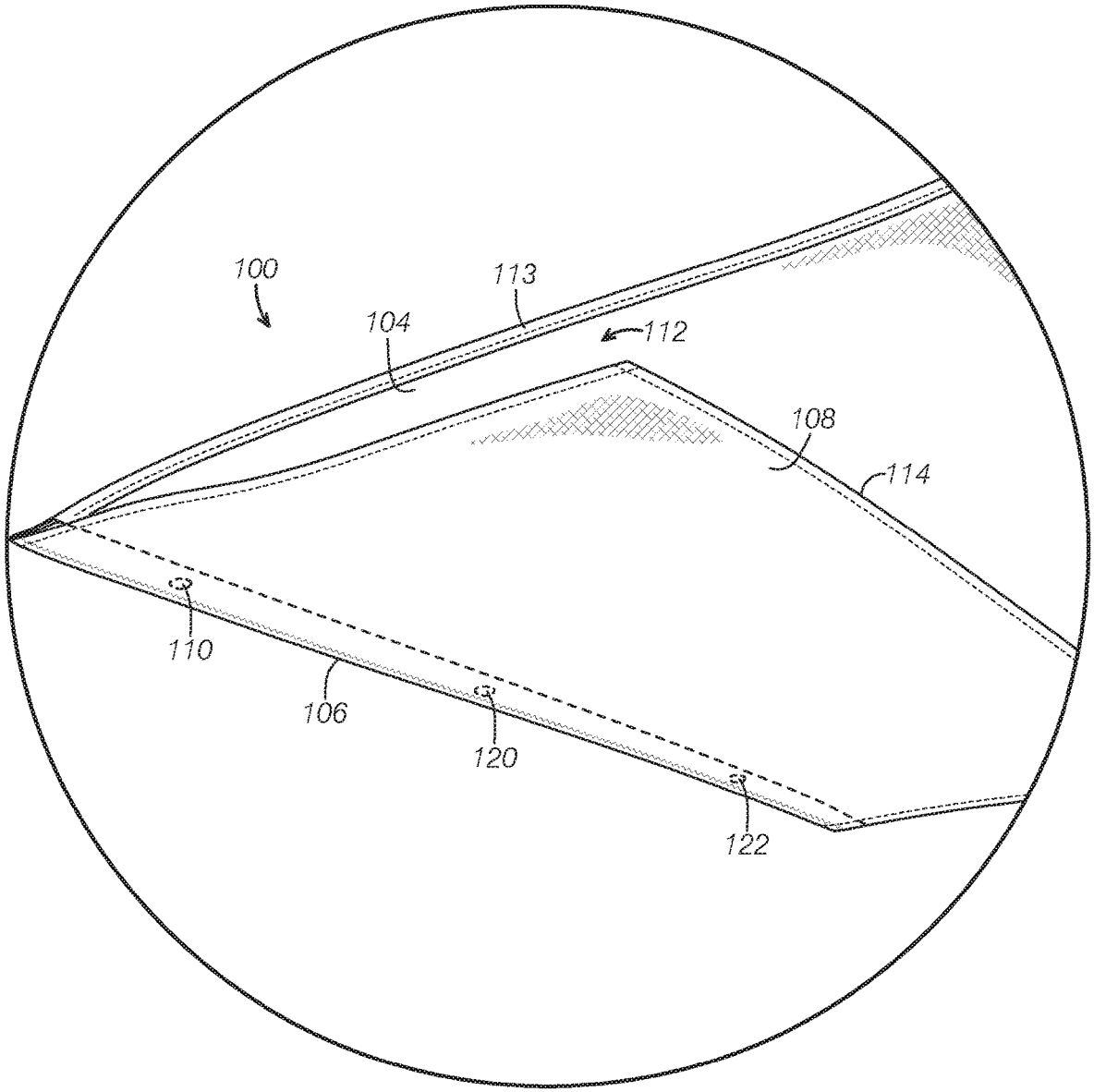
FIG. 5 is a close-up view of a portion of the bedding cover proximate the head of the bed depicting a cover member and the flap member as separate fabric materials stitched together exclusively along a top edge of the bedding cover to define a flap with fasteners disposed proximate the top edge inside the flap.
Figure 6:
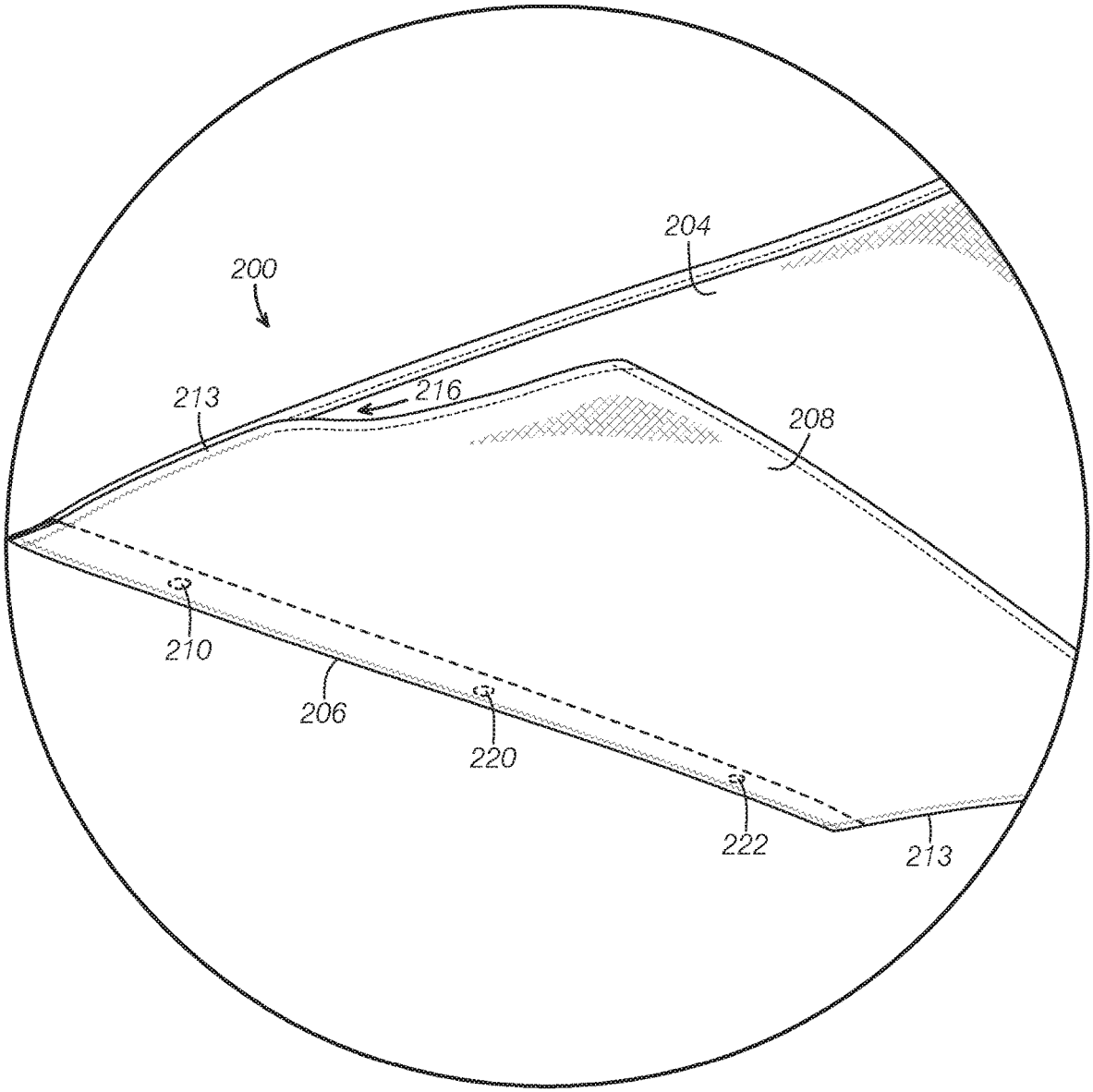
FIG. 6 is a close-up view of a portion of an alternative bedding cover embodiment proximate the head of the bed depicting a cover member and a flap member as separate fabric materials stitched together along a top edge and a portion of lateral sides of the bedding cover to define a pocket with fasteners disposed proximate the top edge inside the pocket.
Figure 7:
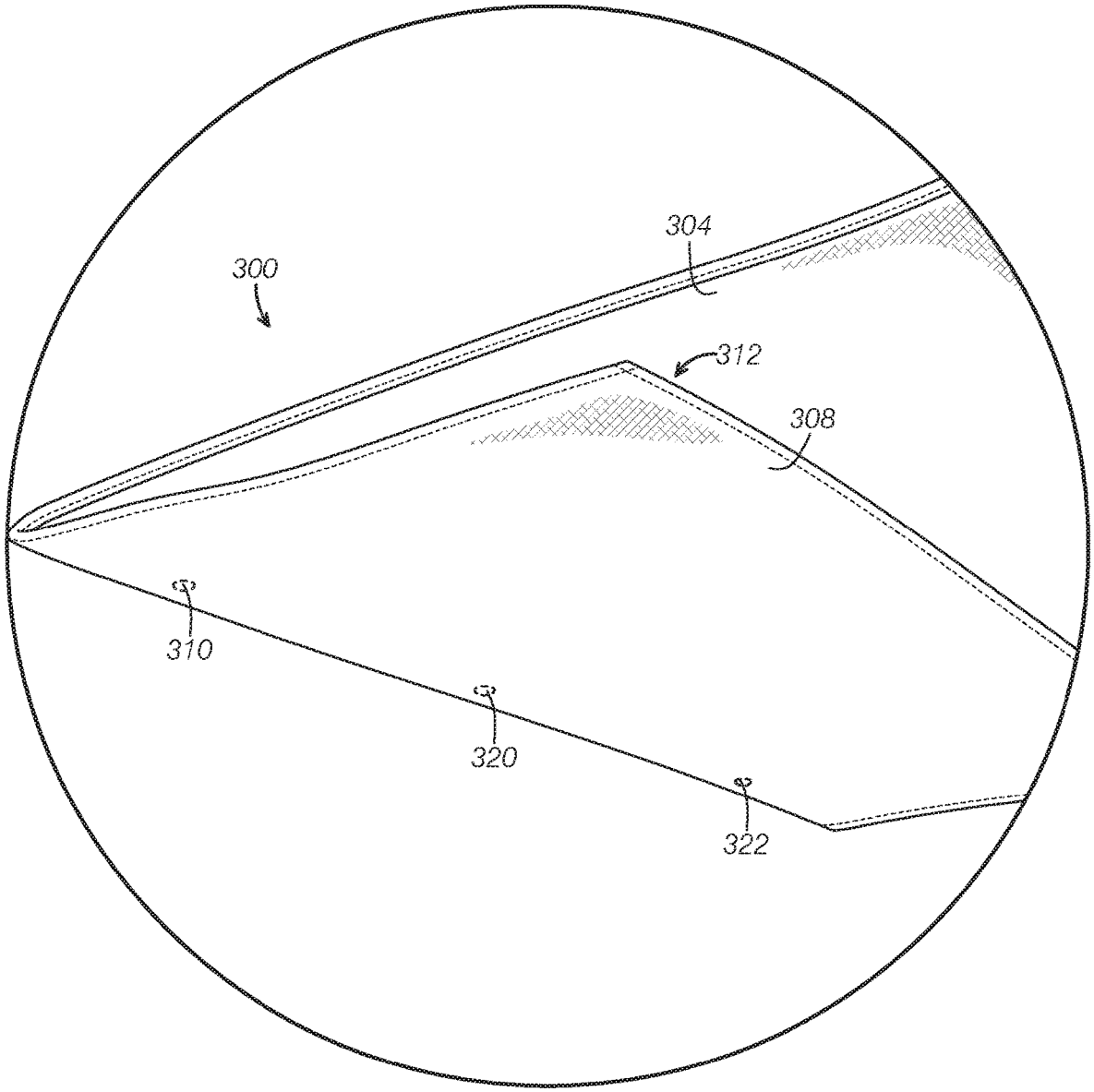
FIG. 7 is a close-up view of a portion of an alternative bedding cover embodiment proximate the head of the bed depicting a cover member and a flap member being portions of a common fabric material folded to define a top edge and a flap of the bedding cover with fasteners disposed proximate the top edge inside the flap to selectively secure to the insulated bedding item.

In the present example, as shown most clearly in FIGS. 4 and 5, flap member 108 is coupled to cover member 104 exclusively along cover top edge 106. An alternative configuration of a bedding cover, bedding cover 200, is shown in FIG. 6 where a flap member 208 is coupled to a cover member 204 along lateral edges 213 proximate a cover top edge 206 to define a pocket 216. A third configuration of a bedding cover, bedding cover 300, is shown in FIG. 7 where a cover member 304 and a flap member 312 are integrally connected from of a common fabric material. Thus, the reader should appreciate that the flap member may secure to the cover member in various configurations or may be a distinct portion of a common piece of material from the cover member portion.

As shown in FIGS. 2, 4, and 5, flap member 108 extends from cover top edge 106 of cover member 104 towards cover bottom edge 118 of cover member 104. In this particular example, flap member 108 terminates a distance less than half the length between cover top edge 106 and cover bottom edge 118. In other examples, the flap member extends further or shorter distances towards the cover bottom edge. The flap member may be any length sufficient to receive and help retain the insulated bedding item within the flap.

Cover Fasteners

Cover fasteners 110, 120, 122, and 130 are configured to secure insulated bedding item 102 to cover member 104. As shown in FIG. 3, cover fasteners 110, 120, 122, and 130 are snaps or interference fit fasteners. A wide variety of other fastener types are suitable, including buttons, magnets, ties, hook-and-loop fasteners, and the like.

The number and location of the cover fasteners will vary between different examples, with some examples including a single cover fastener and other examples including more cover fasteners than depicted in the figures. The cover fasteners may be disposed on either the cover member or the flap member or both the cover member and the flap member. In some example, the cover fasteners are located exclusively at a top edge of the cover or exclusively at the bottom edge. In some examples, such as with bedding cover 400 shown in FIG. 8, there are cover fasteners 410, 420, and 422 located on a flap member 408 proximate a terminal edge 414 of flap member 408 distal a cover top edge 406.

In the example shown in FIGS. 1-5, first cover fastener 110, second cover fastener 120, and third cover fastener 122 are disposed on cover member 104 between cover member 104 and flap member 108 proximate cover top edge 106. As can be seen in FIGS. 4 and 5, second cover fastener 120 is laterally spaced from first cover fastener 110. Third cover fastener 122 is laterally spaced from second cover fastener 120 distal first cover fastener 110. FIGS. 4 and 5 demonstrate that second cover fastener 120 is disposed proximate a lateral middle position of flap 112. First, second, and third cover fasteners 110, 120, and 122 cooperate with flap 112 to secure insulated bedding item 102 within flap 112.

With reference to FIG. 3, the reader can see that cover bottom edge fastener 130 is secured to cover member 104 proximate cover bottom edge 118. The bedding cover may include any number of cover bottom edge fasteners or may omit cover bottom edge fasteners entirely. In the present example, cover bottom edge fastener 130 is configured to secure bedding bottom edge 128 to cover member 104.

Bedding Cover Embodiment Two

Turning attention to FIG. 6, a second example of a bedding cover, bedding cover 200, will now be described. Bedding cover 200 includes many similar or identical features to cover 100. Thus, for the sake of brevity, each feature of cover 200 will not be redundantly explained. Rather, key distinctions between cover 200 and cover 100 will be described in detail and the reader should reference the discussion above for features substantially similar between the two covers.

As can be seen in FIG. 6, bedding cover 200 includes a cover member 204, a flap member 208, a first cover fastener 210, a second cover fastener 220, and a third cover fastener 222. In the example shown in FIG. 6, flap member 208 is coupled to cover member 204 along cover top edge 206 and along lateral edges 213 proximate a cover top edge 206 to define a pocket 216. Flap member 208 coupling to cover member 204 along lateral edges 213 contrasts with the example shown in FIGS. 1-5 where flap member 108 couples to cover member 104 exclusively along cover top edge 106.

Bedding Cover Embodiment Three

With reference to FIG. 7, a third example of a bedding cover, bedding cover 300, will now be described. Bedding cover 300 includes many similar or identical features to cover 100. Thus, for the sake of brevity, each feature of cover 300 will not be redundantly explained. Rather, key distinctions between cover 300 and cover 100 will be described in detail and the reader should reference the discussion above for features substantially similar between the two covers.

As can be seen in FIG. 7, bedding cover 300 includes a cover member 304, a flap member 308, a first cover fastener 310, a second cover fastener 320, and a third cover fastener 322. In the example shown in FIG. 7, cover member 304 and flap member 308 are integrally connected from of a common fabric material rather than cover member 104 being a separate component from flap member 108 as described in the first embodiment bedding cover 100. Examples where the cover member and the flap member are integrally connected dispense with the need to stitch or couple together in some other manner the flap member and the cover member.

Bedding Cover Embodiment Four

Figure 8:
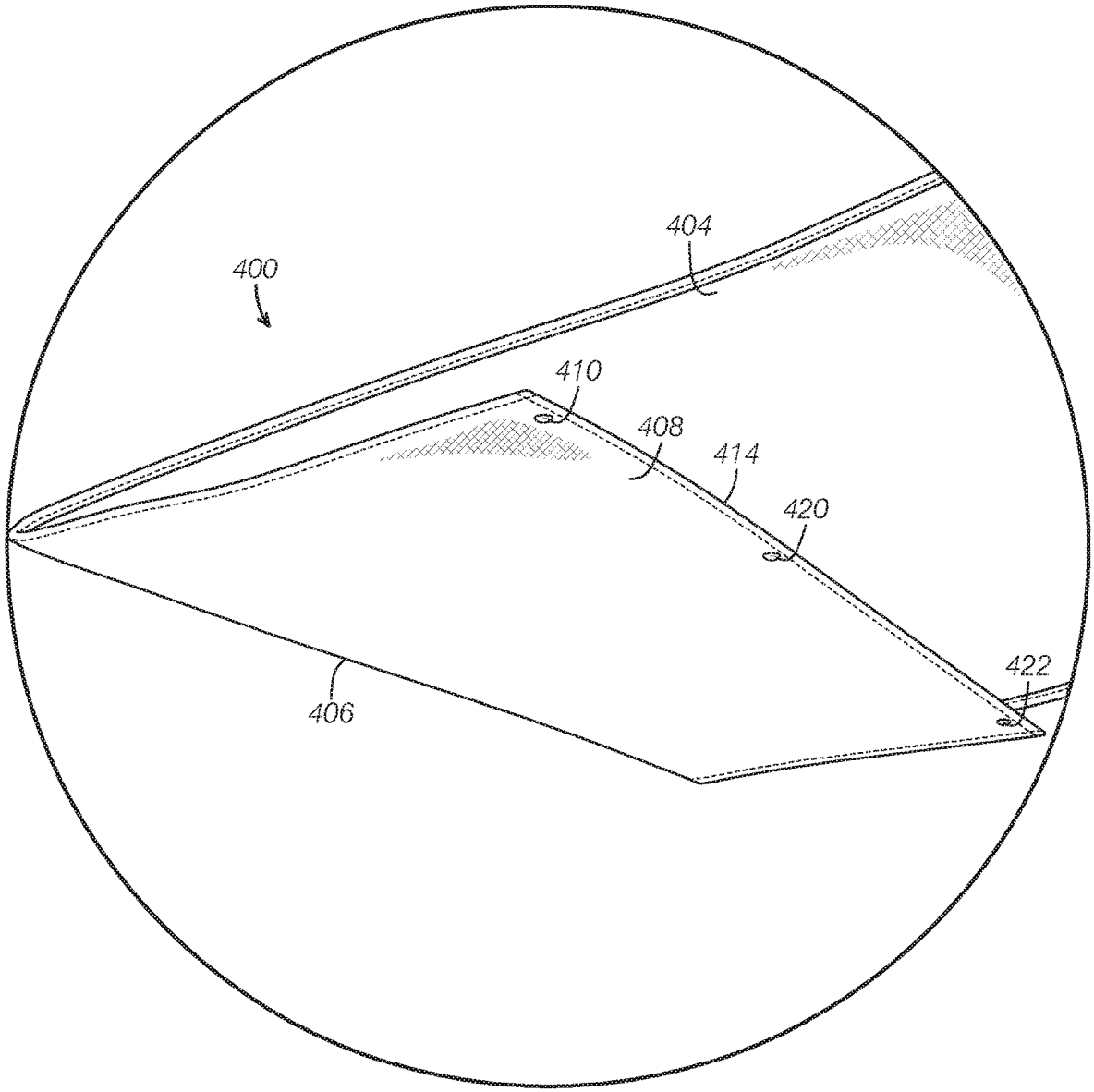
FIG. 8 is a close-up view of a portion of an alternative bedding cover embodiment proximate the head of the bed depicting a cover member and a flap member being portions of a common fabric material folded to define a top edge and a flap of the bedding cover with fasteners disposed proximate a terminal edge of the flap member distal the top edge to selectively secure to the insulated bedding item.

Turning attention to FIG. 8, a fourth example of a bedding cover, bedding cover 400, will now be described. Bedding cover 400 includes many similar or identical features to cover 100. Thus, for the sake of brevity, each feature of cover 400 will not be redundantly explained. Rather, key distinctions between cover 400 and cover 100 will be described in detail and the reader should reference the discussion above for features substantially similar between the two covers.

As can be seen in FIG. 8, bedding cover 400 includes a cover member 404, a flap member 408, a first cover fastener 410, a second cover fastener 420, and a third cover fastener 422. In the example shown in FIG. 8, first cover fastener 410, second cover fastener 420, and third cover fastener 422 are located on flap member 408 proximate a terminal edge 414 of flap member 408 distal a cover top edge 406. The position of cover fasteners 410, 420, and 422 distal cover top edge 406 in the FIG. 8 example contrasts with the example shown in FIGS. 1-5 where cover fasteners 110, 120, and 122 are located proximate cover top edge 106.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A bedding cover for selectively covering an insulated bedding item having a length and a width, the bedding cover comprising:

a cover member complementarily configured with the length and the width of the insulated bedding item, the cover member having a cover top edge having a cover width at least as wide as the width of the insulated bedding item;

a flap member coupled to the cover member along the cover top edge;

wherein:

a top portion of the cover member overlying and in contact with a top surface of an upper portion of the insulated bedding item and the flap member underneath and in contact with a lower surface of the upper portion of the insulated bedding item collectively define a flap configured to receive the upper portion of the insulated bedding item that is proximate to a head of a bed;

a first cover fastener disposed on one of the cover member or the flap member proximate to the cover top edge of the cover member, wherein the first cover fastener is proximate to a corresponding first insulated bedding item fastener disposed proximate to a first top corner of the insulated bedding item, wherein the first cover fastener is configured to fasten with the first insulated bedding item fastener to secure the cover member to the insulated bedding item; and a second cover fastener disposed on one of the cover member or the flap member proximate to the cover top edge of the cover member, wherein the second cover fastener is proximate to a corresponding second insulated bedding item fastener disposed proximate to the second top corner of the insulated bedding item, wherein the second top corner of the insulated bedding item in on an opposing side of the first too corner of the insulated bedding item, and wherein the second cover fastener is configured to fasten with the second bedding item top edge fastener to secure the cover member to the insulated bedding item, and wherein the first cover fastener, the second cover fastener, and the flap defined by the top portion of the cover member and the flap member cooperate to secure the upper portion of the insulated bedding item within the flap.

2. The bedding cover of claim 1, wherein the insulated bedding item is one of a duvet, a comforter, and a blanket.

3. The bedding cover of claim 1, wherein the cover member and the flap member are comprised of a washable fabric material.

4. The bedding cover of claim 1, wherein the first cover fastener and the second cover fastener are disposed on the cover member between the cover member and the flap member proximate the cover top edge.

5. The bedding cover of claim 1, wherein at least a portion of the flap member is secured to a corresponding portion of the cover member along lateral edges of the cover member proximate the cover top edge to define a pocket.

6. The bedding cover of claim 5, wherein the portion of the flap member is secured to the corresponding portion of the cover member using a plurality of third cover fasteners.

7. The bedding cover of claim 1, wherein the flap member is coupled to the cover member exclusively along the cover top edge.

8. The bedding cover of claim 1, wherein the cover member and the flap member are integrally connected from of a common fabric material.

9. The bedding cover of claim 1, wherein the flap member extends from the cover top edge of the cover member towards a cover bottom edge of the cover member opposite the cover top edge and terminates a distance less than half the length between the cover top edge and the cover bottom edge.

10. The bedding cover of claim 1, further comprising:

a third cover fastener laterally spaced between the first cover fastener and the second cover fastener, wherein the third cover fastener is disposed on one of the cover member or the flap member proximate to the cover too edge of the cover member when the insulated bedding item is one of a duvet, a comforter, and a blanket.

11. The bedding cover of claim 10, wherein the third cover fastener is disposed proximate a lateral middle position of the flap.

12. The bedding cover of claim 1, further comprising the insulated bedding item to define a bedding cover system.

13. The bedding cover system of claim 12, wherein the insulated bedding item includes a plurality of bedding fastener complementarily configured with a plurality of cover fasteners.

14. The bedding cover system of claim 13, wherein:

the cover member includes a cover bottom edge opposite the cover top edge;

the insulated bedding item includes a bedding bottom edge underlying the cover bottom edge when the cover member overlies the insulated bedding item; and the bedding cover further comprises a cover bottom edge fastener secured to the cover member proximate the cover bottom edge, the cover bottom edge fastener being configured to secure the bedding bottom edge to the cover member.

15. The bedding cover system of claim 14, wherein the insulated bedding item further comprises a bedding bottom edge fastener aligned with and complementarily configured with the cover bottom edge fastener.

16. A bedding cover system, comprising:

an insulated bedding item including a bedding fastener disposed proximate a bedding top edge, the insulated bedding item having a length and a width; and a bedding cover including:

a cover member complementarily configured with the length and the width of the insulated bedding item and configured to overlie the insulated bedding item, the cover member having:

a cover top edge complementing the width of the insulated bedding item and overlying the bedding top edge; and a flap member coupled to the cover member along the cover top edge;

a first cover fastener disposed on one of the cover member or the flap member proximate to the cover top edge of the cover member, wherein the first cover fastener is proximate to a corresponding first insulated bedding item fastener disposed proximate to a first top corner of the insulated bedding item, and wherein the first cover fastener is configured to fasten with the first insulated bedding item fastener to secure the cover member to the insulated bedding item; and a second cover fastener disposed on one of the cover member or the flap member proximate to the cover too edge of the cover member, wherein the second cover fastener is proximate to a corresponding second insulated bedding item fastener disposed proximate to the second top corner of the insulated bedding item, wherein the second top corner of the insulated bedding item in on an opposing side of the first top corner of the insulated bedding item, and wherein the second cover fastener is configured to fasten with the second bedding item top edge fastener to secure the cover member to the insulated bedding item;

wherein a top portion of the cover member overlying and in contact with a top surface of an upper portion of the insulated bedding item and the flap member underneath and in contact with a lower surface of the upper portion of the insulated bedding item collectively define a flap configured to receive the upper portion of the insulated bedding item that is proximate to a head of a bed; and wherein the first bedding item fastener, the second bedding item fastener, the first cover fastener, the second cover fastener, and the flap defined by the top portion of the cover member and the flap member cooperate to secure the upper portion of the insulated bedding item within the flap.

17. The bedding cover system of claim 16, wherein the first cover fastener and the second cover fastener are disposed on the cover member between the cover member and the flap member proximate the cover top edge.

18. The bedding cover system of claim 17, wherein the cover member and the flap member are comprised of a washable fabric material.

19. The bedding cover system of claim 18, wherein the insulated bedding item is one of a duvet, a comforter, and a blanket.

* * * * *